US009386633B2

(12) United States Patent
Igarashi et al.

(10) Patent No.: US 9,386,633 B2
(45) Date of Patent: Jul. 5, 2016

(54) HEATER CONTROL METHOD AND HEATER CONTROL APPARATUS FOR GAS SENSOR

(71) Applicant: NGK SPARK PLUG CO., LTD., Nagoya-shi, Aichi (JP)

(72) Inventors: Ai Igarashi, Konan (JP); Hiroyuki Hayashi, Konan (JP); Tomohisa Terui, Ichinomiya (JP); Kaoru Hisada, Obu (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 106 days.

(21) Appl. No.: 14/189,540

(22) Filed: Feb. 25, 2014

(65) Prior Publication Data

US 2014/0238973 A1 Aug. 28, 2014

(30) Foreign Application Priority Data

Feb. 26, 2013 (JP) ..... 2013-035376

(51) Int. Cl.
*H05B 1/02* (2006.01)

(52) U.S. Cl.
CPC ..... *H05B 1/0247* (2013.01); *H05B 1/023* (2013.01)

(58) Field of Classification Search
CPC .... H05B 1/0247; H05B 1/023; H05B 1/0236; H05B 3/0042
USPC ..... 219/497, 505, 492, 506, 202, 206
See application file for complete search history.

(56) References Cited

U.S. PATENT DOCUMENTS

| | | | | |
|---|---|---|---|---|
| 6,336,354 | B1 | 1/2002 | Suzuki et al. | |
| 7,036,982 | B2 * | 5/2006 | Smith | F02D 41/1494 123/679 |
| 7,841,769 | B2 * | 11/2010 | Ma | F02D 41/1446 374/144 |
| 2002/0179443 | A1 * | 12/2002 | Hada | F02D 41/1494 204/408 |

FOREIGN PATENT DOCUMENTS

| | | | |
|---|---|---|---|
| EP | 1 026 501 | A2 | 8/2000 |
| JP | 9-127035 | A | 5/1997 |
| JP | 2000-206082 | A | 7/2000 |

OTHER PUBLICATIONS

Communication dated Jan. 27, 2016 from the State Intellectual Property Office of the P.R.C. in application No. 201410067138.3.

* cited by examiner

*Primary Examiner* — Mark Paschall
(74) *Attorney, Agent, or Firm* — Sughrue Mion, PLLC

(57) ABSTRACT

A heater control method and apparatus for a gas sensor which can quickly activate a detection element while reducing load due to heating even when a higher power supply voltage is applied. A heater element is connected to a power supply whose voltage is higher than 16 V, and power is supplied under PWM control such that a temperature rise of the heater element follows a temperature rise curve obtained when a voltage of 12 V is applied to the heater element. Even though a higher voltage is applied, the temperature rise per unit time during the ON time of the PWM control is decreased. This is because the ON time per cycle is shortened by increasing the PWM frequency to 30 Hz or higher. Thus, the temperature rise per cycle is kept low, whereby the temperature rise per 0.1 second is rendered less than 25° C.

4 Claims, 3 Drawing Sheets

HEATER CONTROL METHOD AND HEATER CONTROL APPARATUS FOR GAS SENSOR

BACKGROUND OF THE INVENTION

1. Field of the Invention

The present invention relates to a heater control method and a heater control apparatus for controlling energization of a heater which is used to activate a detection element of a gas sensor.

2. Description of the Related Art

Conventionally, a gas sensor has been known which includes a detection element including at least one cell composed of a solid electrolyte body and a pair of electrodes and which detects the concentration of a specific gas (e.g., oxygen). The detection element becomes active when its temperature rises, whereby an electromotive force is generated between the pair of electrodes in accordance with a difference in oxygen concentration between two atmospheres separated by the solid electrolyte body. The detection element is heated by the heat of exhaust gas discharged from an internal combustion engine. In addition, in order to activate the detection element quickly, a heater is provided in the gas sensor. A power supply voltage is applied to the heater. However, if the power supply voltage is too high, the temperature rise per unit time becomes large, and an excessive load (mechanical stress) acts on the detection element. As a result, the detection element may crack or suffer from other damage.

An apparatus has been known which overcomes such a drawback by energizing the heater using PWM control (where "PWM" is an abbreviation for "pulse width modulation") (refer to, for example, Patent Document 1). In the case where an effective voltage applied or more particularly, cumulative power input to the heater is controlled by means of PWM control, a temperature rise curve representing a rise in the temperature of the heater per unit time can be brought closer to a desired temperature rise curve. Thus, a required rate of temperature rise of the heater can be achieved efficiently while reducing the load on the detection element.

[Patent Document 1] Japanese Patent Application Laid-Open (kokai) No. H9-127035.

PROBLEMS TO BE SOLVED BY THE INVENTION

There is a need for use of a gas sensor in a vehicle whose power supply voltage is higher than that conventionally employed (e.g., a vehicle whose power supply voltage is higher than 16 V). This demand can be satisfied by energizing the heater under PWM control, while setting the duty ratio used therein in accordance with the power supply voltage, such that the effective voltage applied to the heater becomes equal to a conventional effective voltage. However, it was found that energizing the heater under PWM control may cause cracking of the detection element. The results of studies by the inventors show that, although an ON time (energization period) in each cycle of PWM control becomes shorter than that in the conventional apparatus, the heater temperature rises more sharply than in the conventional apparatus during the ON time. This is because the voltage applied to the heater (hereinafter also referred to as the "application voltage") during the ON time is higher as compared with the conventional apparatus. The temperature rise of the heater during the ON time can be decreased by decreasing the duty ratio such that the ON time becomes shorter. However, in this case, a problem arises in that the effective voltage applied to the heater is decreased and consequently the temperature rise curve of the heater becomes more gradual than the temperature rise curve attained through use of the conventional apparatus, whereby it takes a longer time to activate the detection element.

SUMMARY OF THE INVENTION

The present invention has been made to solve the above-described problem, and an object of the present invention is to provide a heater control method and a heater control apparatus for a gas sensor which can activate the detection element of the gas sensor quickly while reducing the load acting thereon due to heating, even when the power supply voltage applied to the heater of the gas sensor is higher than that conventionally employed.

The above object of the invention has been achieved, according to a first aspect of the present invention, by providing a heater control method for controlling energization of a heater of a gas sensor, the gas sensor comprising:

a gas detection element having at least one cell composed of a solid electrolyte body and a pair of electrodes provided thereon, and a heater which generates heat, when a power supply voltage is applied to the heater from a power supply apparatus, so as to heat and activate the gas detection element, the power supply voltage applied from the power supply apparatus to the heater being higher than 16 V. The heater control method comprises applying the power supply voltage to the heater and stopping application of the power supply voltage using a switching means; and controlling energization of the heater by operating the switching means under PWM control at a PWM frequency of 30 Hz or higher. The PWM control is performed such that the switching means is operated at a duty ratio of less than 100%, whereby the temperature of the heater does not change 25° C. or more per 0.1 second, and an effective value of the voltage applied to the heater is equal to a lower application voltage set for the heater in advance.

According to the heater control method for a gas sensor according to the first aspect, the PWM frequency is set to 30 Hz or higher. Thus, it becomes possible to shorten the ON time in each cycle. Therefore, even if a power supply voltage higher than 16 V is applied to the heater, the temperature rise of the heater during the ON time can be held to a low value. Accordingly, by performing PWM control at a PWM frequency of 30 Hz or higher while setting the duty ratio such that the temperature rise of the heater per 0.1 second becomes smaller than 25° C., the load acting on the detection element can be reduced. In addition, even if the ON time is shortened, the effective value of the voltage applied to the heater can be maintained. Therefore, the detection element can be activated quickly.

The language "the lower applied voltage set for the heater in advance" means a value of a voltage such that a lapse of time from a state of a normal temperature to a temperature at which detecting a gas is possible becomes less than 15 seconds and such that an effective value becomes less than 16 V.

According to a second aspect, the present invention provides a heater control apparatus for controlling energization of a heater of a gas sensor, the gas sensor comprising:

a gas detection element having at least one cell composed of a solid electrolyte body and a pair of electrodes provided thereon, and a heater which generates heat, when a power supply voltage is applied from a power supply apparatus, so as to heat and activate the gas detection element, the power supply voltage applied from the power supply apparatus to the heater being higher than 16 V. The heater control apparatus comprises switching means for applying the power supply voltage to the heater and stopping application of the power supply voltage; and control means for controlling the energization of the heater by operating the switching means under PWM control at a PWM frequency of 30 Hz or higher, said control means performing the PWM control such that the switching means is operated at a duty ratio of less than 100%, whereby the temperature of the heater does not change 25° C. or more per 0.1 second, and an effective value of the voltage applied to the heater is equal to a lower application voltage set for the heater in advance.

According to the heater control apparatus for a gas sensor according to the second aspect, the control means sets the PWM frequency (at which the switching means is driven) to 30 Hz or higher. Thus, it becomes possible to shorten the ON time in each cycle. Therefore, even if a power supply voltage higher than 16 V is applied to the heater, the temperature rise of the heater during the ON time can be held to a low value. Accordingly, by performing PWM control at a PWM frequency of 30 Hz or higher while setting the duty ratio such that the temperature rise of the heater per 0.1 second becomes smaller than 25° C., the load acting on the detection element can be reduced. In addition, even if the ON time is shortened, the effective value of the voltage applied to the heater can be maintained. Therefore, the detection element can be activated quickly.

As used herein, the term "effective voltage" means cumulative power input to the heater.

DESCRIPTION OF REFERENCE NUMERALS

Figure 1:
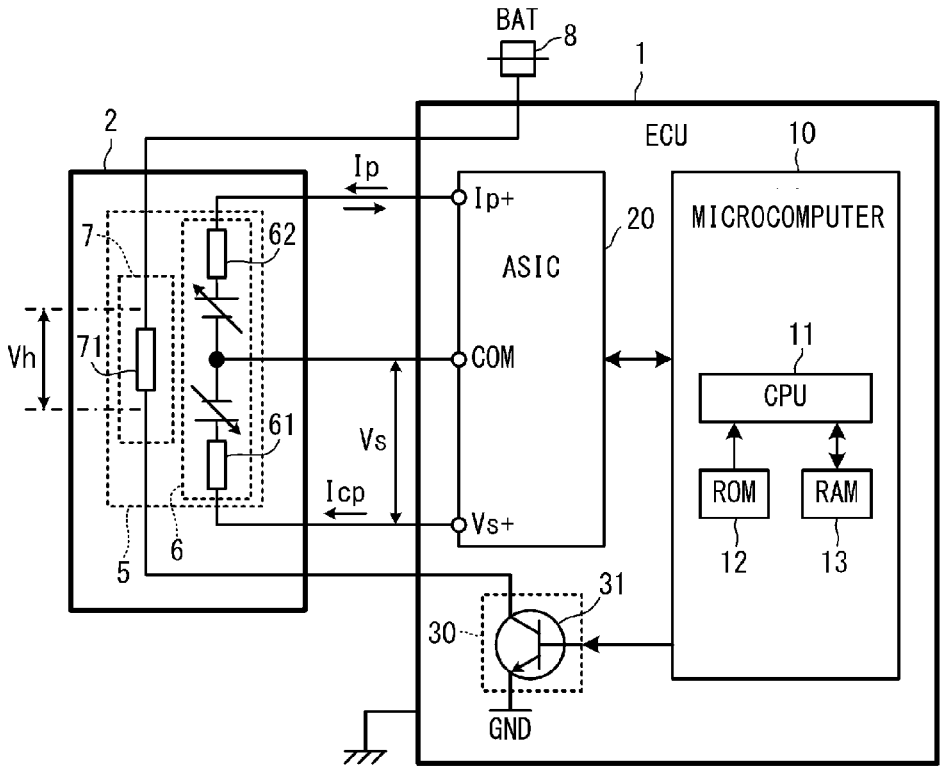
FIG. 1 is a block diagram showing the electrical configuration of a full range air-fuel ratio sensor 2 including a heater element 7 and the configuration of a sensor control apparatus 1.

Reference numerals used to identify various features in the drawings include the following.

1: sensor control apparatus
2: full range air-fuel ratio sensor
6: gas detection element
7: heater element
8: battery
11: CPU
31: switching device
61: Vs cell
62: Ip cell

DETAILED DESCRIPTION OF THE PREFERRED EMBODIMENTS

An embodiment of the present invention (i.e., a heater control method and a heater control apparatus for a gas sensor) will now be described with reference to the drawings. However, the present invention should not be construed as being limited thereto. First, with reference to FIG. 1, the electrical configuration of a sensor control apparatus 1 will be described for controlling the drive of a so-called full range air-fuel ratio sensor 2, which is an example of the heater control apparatus.

The sensor control apparatus 1 shown in FIG. 1 is an electronic control unit (ECU) installed in a vehicle, and is electrically connected to the full range air-fuel ratio sensor 2. The full range air-fuel ratio sensor 2 is an example of the gas sensor used in the present embodiment. The output value of the full range air-fuel ratio sensor 2 (the value of a detection signal) varies linearly in accordance with the concentration of oxygen contained in exhaust gas which is discharged from an engine. Notably, since the full range air-fuel ratio sensor 2 is well known, its structure, etc., will not be described in detail, and only its schematic configuration will be described below.

The full range air-fuel ratio sensor 2 has a structure in which an elongate, plate-like sensor element 5 is held in an unillustrated housing. A signal line for sending a signal output from the sensor element 5 extends from the full range air-fuel ratio sensor 2, and is electrically connected to the sensor control apparatus 1 which is installed away from the full range air-fuel ratio sensor 2.

As is well known, the sensor element 5 is an element in which a gas detection element 6 for detecting the concentration of oxygen contained in exhaust gas is integrated with a heater element 7 for heating the gas detection element 6. The gas detection element 6 has two types of cells (a Vs cell 61 and an Ip cell 62). Each of these cells is composed of an oxygen-ion-conducting solid electrolyte body which is mainly formed of zirconia; and a pair of electrodes which are mainly formed of Pt and which are provided on the front and back surfaces of the solid electrolyte body. The gas detection element 6 has a structure in which the above-described Vs cell 61 and the Ip cell 62 are stacked to form an unillustrated gas detection chamber, which is a small chamber into which exhaust gas can be introduced. One electrode of the Vs cell 61 and one electrode of the Ip cell 62 are exposed to the space of the gas detection chamber. These electrodes are electrically connected together, and are connected, via an unillustrated signal line, to a COM port of an ASIC 20 (described below) included in the sensor control apparatus 1. The other electrode of the Vs cell 61 functions as an oxygen reference electrode which is used as a reference for detection of the concentration of oxygen contained in the exhaust gas introduced into the above-described detection chamber, and is connected to a Vs+ port of the ASIC 20 via an unillustrated signal line. Meanwhile, the other electrode of the Ip cell 62 is exposed to the atmosphere outside the gas detection element 6 in order to exchange oxygen between the gas detection chamber and the outside atmosphere, and is electrically connected to an Ip+ port of the ASIC 20.

The heater element 7 heats the solid electrolyte bodies of the gas detection element 6 in order to activate it quickly. After activating the gas detection element 6, the heater element 7 maintains the temperatures of the solid electrolyte bodies, to thereby ensure stable operation of the gas detection element 6. The heater element 7 has a structure in which a heat generation resistor 71 mainly formed of platinum is disposed between two insulating substrates mainly formed of alumina. Notably, since the specific structure of the sensor element 5 is commonly known, the electrical circuit configuration of the full range air-fuel ratio sensor 2 including the sensor element 5 is shown in FIG. 1.

Next, the schematic configuration of the sensor control apparatus 1 will be described to which the full range air-fuel ratio sensor 2 is connected. The sensor control apparatus 1 includes a microcomputer 10, the above-mentioned ASIC 20, and a heater control circuit 30. In addition, the sensor control apparatus 1 includes unillustrated circuits (apparatuses) relating to control of the engine. The microcomputer 10 controls, via the ASIC 20 and the heater control circuit 30, supply of power to the full range air-fuel ratio sensor 2, and receives from the gas detection element 6 a voltage signal representing a current value corresponding to the concentration of oxygen contained in exhaust gas.

The microcomputer 10 is an apparatus for electronically controlling the drive of an automobile engine, among other operations. The microcomputer 10 executes various control programs so as to control the circuits (apparatuses) connected thereto, including the ASIC 20, to thereby control fuel injection timings and ignition timings. In order to do so, the microcomputer 10 outputs to the ASIC 20 and the heater control circuit 30, via an unillustrated signal input/output section, a signal for controlling supply of power to the full range air-fuel ratio sensor 2. In addition, the microcomputer 10 obtains, via the ASIC 20, an output (a detected signal) from the full range air-fuel ratio sensor 2. In addition, the microcomputer 10 receives information such as the crank angle (from which piston positions and rotational speed of the engine can be detected) and combustion pressure of the engine.

The microcomputer 10 includes a CPU 11, a ROM 12 and a RAM 13, each of which has a commonly-known configuration. The CPU 11 performs various types of control including the above-described control. The ROM 12 stores programs, initial values, etc., for performing the various types of control. The RAM 13 temporarily stores various variables, flags, counters, etc., which are used to execute the programs.

The ASIC 20 is an application-specific integrated circuit chip in which circuits for driving and controlling the full range air-fuel ratio sensor 2 are integrated such that it can be easily incorporated in the sensor control apparatus 1. The ASIC 20 supplies power to the gas detection element 6 in accordance with a signal received from the microcomputer 10, and notifies the microcomputer 10 of the oxygen concentration detected by the gas detection element 6. Specifically, the ASIC 20 supplies a minute constant current Icp to the Vs cell 61 of the gas detection element 6 in order to move oxygen ions toward the electrode connected to the Vs+ port. In this way, oxygen accumulates at the electrode connected to the Vs+ port, which functions as an oxygen reference electrode. In addition, the ASIC 20 detects an electromotive force Vs generated between the pair of electrodes of the Vs cell 61, and compares it with a predetermined reference voltage (e.g., 450 mV). By controlling the flow direction and magnitude of a pump current Ip flowing between the pair of electrodes of the Ip cell 62 on the basis of the result of the above-described comparison, the IP cell 62 pumps oxygen into the gas detection chamber and pumps oxygen out of the gas detection chamber. The Vs cell 61 and the Ip cell 62 each has an internal resistances. It is known that the resistance (internal resistance or impedance) decreases with increasing temperature of the solid electrolyte bodies constituting the respective cells. It is also known that there is a predetermined correlation between the internal resistance and the temperature of each of the Vs cell 61 and the Ip cell 62. The ASIC 20 separately detects a change in internal resistance of the Vs cell 61, and outputs the detection result to the microcomputer 10.

The heater control circuit 30 controls application of a voltage Vh from a battery 8 to the heat generation resistor 71 of the heater element 7 provided in the sensor element 5. Specifically, the heater control circuit 30 includes a switching device 31 (e.g., a transistor) for supplying electric power to the heat generation resistor 71 by means of PWM (Pulse Width Modulation) control. The CPU 11 of the microcomputer 10 computes the duty ratio of the voltage waveform of the voltage Vh applied between opposite ends of the heat generation resistor 71. Specifically, the ASIC 20 detects the internal resistance of the Vs cell 61 corresponding to a heated state thereof, and the CPU 11 calculates the required duty ratio based on a change in the internal resistance and in accordance with a commonly-known equation or a table prepared in advance. By means of a pulse signal output from the CPU 11, the heater control circuit 30 applies a voltage Vh to the heat generation resistor 71 having a voltage waveform corresponding to the calculated duty ratio. The heat generation resistor 71 produces heat, to thereby heat the Ip cell 61 and the Vs cell 62. Notably, the switching device 31 of the heater control circuit 30 is not limited to the above-described transistor, and an FET or the like may be used.

Figure 2:
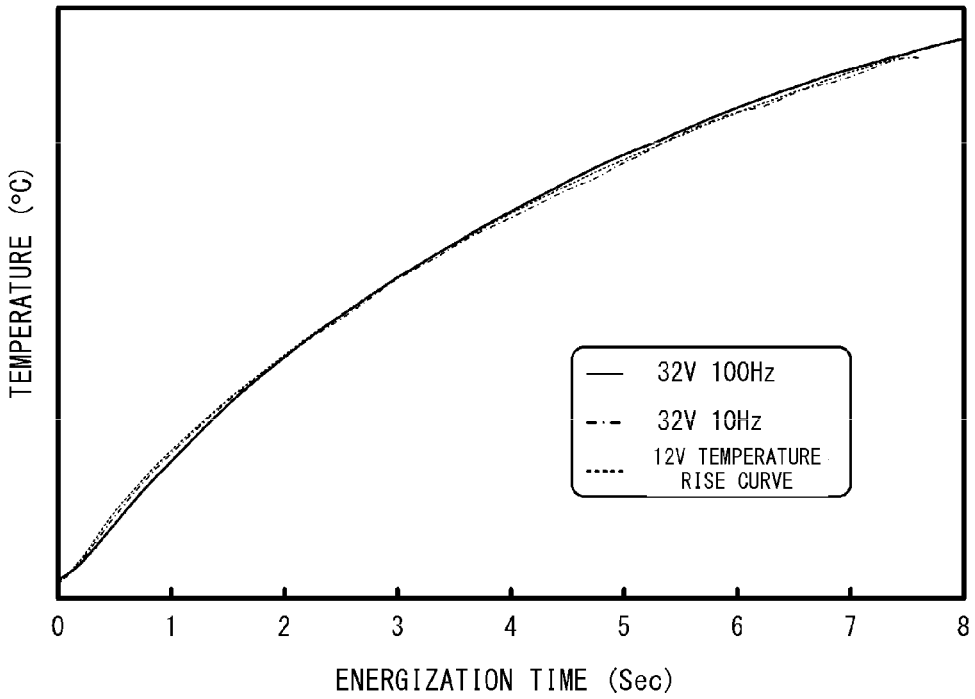
FIG. 2 is a graph showing temperature rise curves, each of which represents temperature as a function of energization time of the heater element 7.

Incidentally, as shown in FIG. 2, it is known that a curve representing the relation between a period of time during which the heat generation resistor 71 is energized and a rise in temperature of the heater element 7 (hereinafter also referred to as a "temperature rise curve") is identical to a curve which represents the power input to the heat generation resistor 71 (a curve indicating how the temperature changes). In order to ensure quick activation of the gas detection element 6, preferably, the power supplied to the heater element 7 (the heat generation resistor 71) is increased such that the temperature of the heater element 7 reaches, in a shorter time, a temperature at which the gas detection element 6 can be activated. However, the gas detection element 6 may crack or break if there is a large temperature rise during the shortened activation time.

In the present embodiment, a temperature rise curve obtained when the effective voltage applied to the heater element 7 is 12 V (hereinafter also referred to as a "12 V temperature rise curve"; notably, in FIG. 2, this curve is represented by a dotted line) is employed as a temperature rise curve which allows for quick activation of the gas detection element 6 while reducing the load acting on the solid electrolyte bodies. The power supply voltage of the battery 8 may differ among vehicles in which the sensor control apparatus 1 is provided. Therefore, the sensor control apparatus 1 performs PWM control such that the temperature rise of the heater element 7 follows the 12 V temperature rise curve.

Specifically, in the present embodiment, particularly in the case where the sensor control apparatus 1 (the heater element 7) is connected to a battery 8 whose power supply voltage is higher than 16 V, the CPU 11 sets the frequency of the pulse signal output to the heater control circuit 30 (PWM frequency) to 30 Hz or higher (e.g., 100 Hz). Namely, the CPU 11 of the sensor control apparatus 1 turns the switching device 31 ON and OFF once (in each cycle of PWM control) at the timing set in accordance with the duty ratio. The CPU 11 performs such PWM control after setting the length of one cycle of PWM control to 0.01 second (for the case where the PWM frequency is 100 Hz). In addition, the CPU 11 sets the duty ratio such that the change in temperature of the heater element 7 becomes less than 25° C. per 0.1 second. By virtue of the above-described two settings, the load on the gas detection element 6 can be reduced even when the power supply voltage of the battery 8 applied to the heater element 7 is higher than 16 V.

PWM control of the heater element 7 is performed based on the above-described settings for the following reason. Notably, according to the 12 V temperature rise curve observed when the effective voltage applied to the heater element 7 is 12 V, the temperature of the heater element 7 becomes T1° C. when a predetermined time has elapsed after the start of energization, and becomes T2° C. after elapse of 0.1 second, following elapse of the predetermined time.

For example, a case will be considered where the sensor control apparatus 1 is connected to the battery 8 whose power supply voltage is 16 V, the PWM frequency is set to 10 Hz, and PWM control is performed in which the duty ratio is set such that the temperature rise of the heater element 7 follows the 12 V temperature rise curve (target). Since the PWM frequency is 10 Hz, the length of one PWM cycle is 0.1 second. The CPU 11 computes the duty ratio based on the internal resistance of the Vs cell 61 such that the temperature of the heater element 7 (heat generation resistor 71) becomes T2° C. after elapse of 0.1 second, following elapse of the predetermined time from the start of energization (see FIG. 3). If the temperature of the heater element 7 (heat generation resistor 71) after elapse of the predetermined time from the start of energization is T1° C. just as in the case where the applied power supply voltage is 12 V, the CPU 11 sets the duty ratio such that the effective voltage becomes 12 V. In this case, between 0 and P seconds, the switching device 31 is turned ON, whereby 16 V is applied to the heater element 7. Between P and 0.1 seconds, the switching device 31 is turned OFF. While the switching device 31 is turned ON (hereinafter also referred to as an "ON time"), the temperature of the heater element 7 (heat generation resistor 71) rises Tx° C. due to application of the 16 V power supply voltage. While the switching device 31 is turned OFF (hereinafter also referred to as an "OFF" time), the temperature of the heater element 7 (heat generation resistor 71) decreases due to natural cooling, whereby the temperature of the heater element 7 (heat generation resistor 71) decreases to T2° C. after elapse of 0.1 second, following elapse of the predetermined time.

Figure 3:
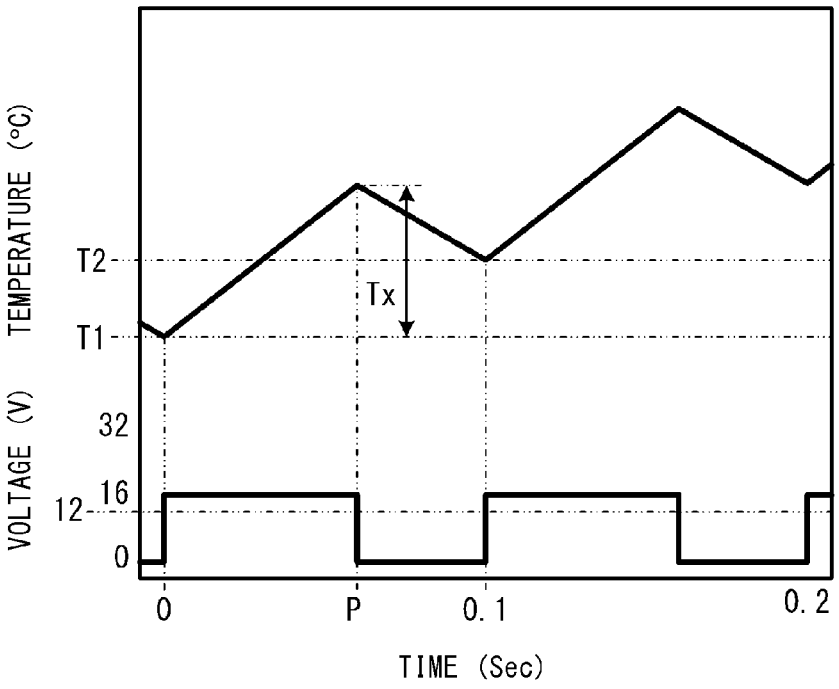
FIG. 3 is a graph showing a change in temperature of the heater element 7 which is energized with a power supply voltage set to 16 V and a PWM frequency set to 10 Hz.

Next, unlike the temperature rise curve of FIG. 3, the 12 V temperature rise curve of FIG. 2 shows a rise in temperature even during the OFF time for the following reason. Notably, in FIG. 2, the temperature of the heater element 7 is a value which is measured using a temperature detector with a thermocouple contacting the surface of the heater element 7 at a position over the pattern of the heat generation resistor 71 formed inside the heater element 7. Therefore, due to resolution of the temperature detector, the temperature rise curve may show a stepwise temperature change whose duration is shorter than the length of one PWM cycle. During the ON time, the temperature of the heater element 7 rises due to generation of heat by the heat generation resistor 71. During the OFF time subsequent to the ON time, as shown in FIG. 3, the temperature of the heat generation resistor 71 decreases. However, since the temperature of the heat generation resistor 71 is still higher than the temperature of the surface of the heater element 7, the temperature of the heater element 7 continues to rise. When the temperature of the surface of the heater element 7 rises and approaches the temperature of the heat generation resistor 71, the rate of temperature rise becomes low; however, the temperature of the surface of the heater element 7 continues to rise. In FIG. 3, in order to facilitate the description of operation, the temperature of the heater element 7 is illustrated as rising during the ON time and fall during the OFF time. This may be true when the temperature of the heat generation resistor 71 is measured directly or when the PWM frequency is extremely low. Meanwhile, in the case where the surface temperature of the heater element 7 is measured, it may continue to rise with its rate of rise changing from one PWM cycle to another.

The present inventors confirmed that, in the case where a battery 8 whose power supply voltage is 32 V (higher than 16 V) is used, the gas detection element 6 may crack or break in the case where the sensor control apparatus 1 performs PWM control such that the temperature rise of the heater element 7 follows the 12 V temperature rise curve (target).

As shown in FIG. 2, the 12 V temperature rise curve shows that the temperature rise per unit time changes with the time elapsed from the start of energization. The 12 V temperature rise curve shows that the temperature rise per unit time is large at the beginning of the energization. The inventors found that, by controlling the temperature rise per unit time at the beginning of the energization, cracking and breakage of the gas detection element 6 can be prevented even in a period during which the gas detection element 6 is likely to crack or break due to the load acting thereon (e.g., even in a period during which the heater element 7 is at an increased temperature).

Figure 4:
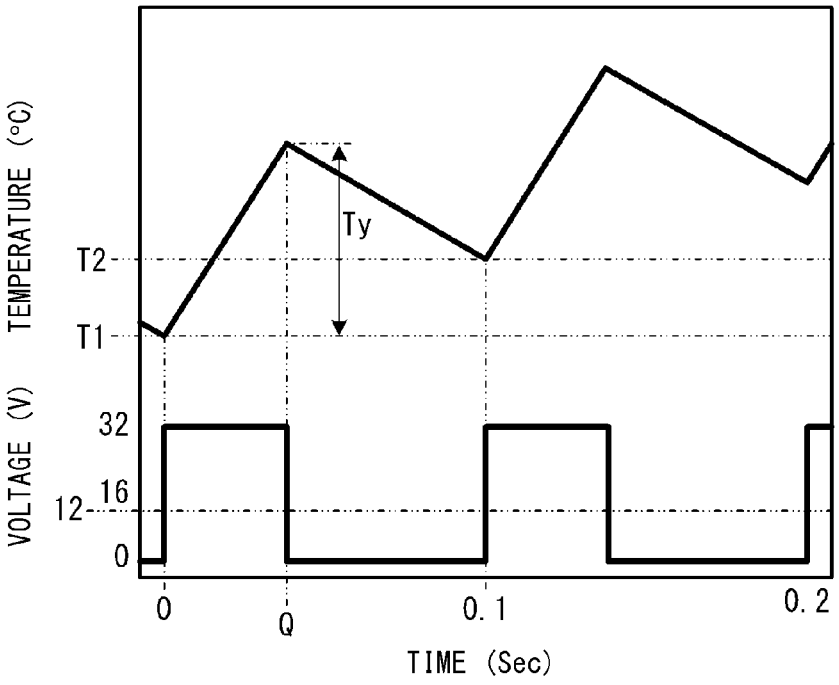
FIG. 4 is a graph showing the change in temperature of the heater element 7 which is energized with the power supply voltage set to 32 V and the PWM frequency set to 10 Hz.

A case will be considered where a battery 8 whose power supply voltage is 32 V is connected to the sensor control apparatus 1. The PWM frequency is set to 10 Hz as in the above-described case, and PWM control is performed in which the duty ratio is set such that the temperature of the heater element 7 rises to follow the 12 V temperature rise curve (target) (see FIG. 2). As shown in FIG. 4, the length of one PWM cycle is 0.1 second. Since the temperature of the heater element 7 (heat generation resistor 71) is T1° C. after elapse of the predetermined time from the start of energization, the CPU 11 sets the duty ratio such that the effective value of the voltage applied to the heater element 7 becomes 12 V. During the ON time between 0 and Q seconds, 32 V is applied to the heater element 7. The ON time is followed by the OFF time which lasts from Q second to 0.1 second. After elapse of the OFF time, one cycle ends. In the case where 32 V is applied, the rate of temperature rise of the heater element 7 (the slope of a line representing the temperature rise) during the ON time is greater than that observed in the case where 16 V is applied. The temperature of the heater element 7 (heat generation resistor 71) rises Ty° C. due to application of 32 V during the ON time, falls due to natural cooling during the OFF time, and becomes T2° C. after elapse of 0.1 second, following elapse of the predetermined time, just as in the case mentioned above. The temperature rise Ty° C. of the heater element 7 during the ON time which is observed in the case where the PWM frequency is 10 Hz and the power supply voltage is 32 V is greater than the temperature rise Tx° C. during the ON time which is observed in the case where the PWM frequency is set to 10 Hz and the power supply voltage is 16 V.

As shown in FIG. 2, in the case where the PWM frequency was set to 10 Hz and the power supply voltage was 32 V (the temperature rise curve obtained in such a case is represented by a long and short dash line), the maximum temperature rise of the heater element 7 per 0.1 second was 25.5° C.

As mentioned above, in the case where the power supply voltage of the battery 8 connected to the sensor control apparatus 1 is 32 V, the temperature rise during the ON time is Ty° C., which is relatively large, because the PWM frequency is set to 10 Hz, whereby an excessive load is liable to act on the gas detection element 6. As a result, the gas detection element 6 may crack or break.

In the case where the power supply voltage of the battery 8 is 32 V (higher than 16 V) and the sensor control apparatus 1 performs PWM control such that the temperature of the heater element 7 rises to follow the 12 V temperature rise curve (target), a large load may act on the solid electrolyte bodies. Such a load can be reduced by reducing the power supplied to the heater element 7. However, a decrease in the rate of temperature rise of the heater element 7 due to a reduction in the power supplied to the heater element 7 affects quick activation of the gas detection element 6. The inventors have conceived a technique for solving this problem by increasing the PWM frequency so as to activate the gas detection element 6 quickly while lowering the temperature rise per cycle.

Figure 5:
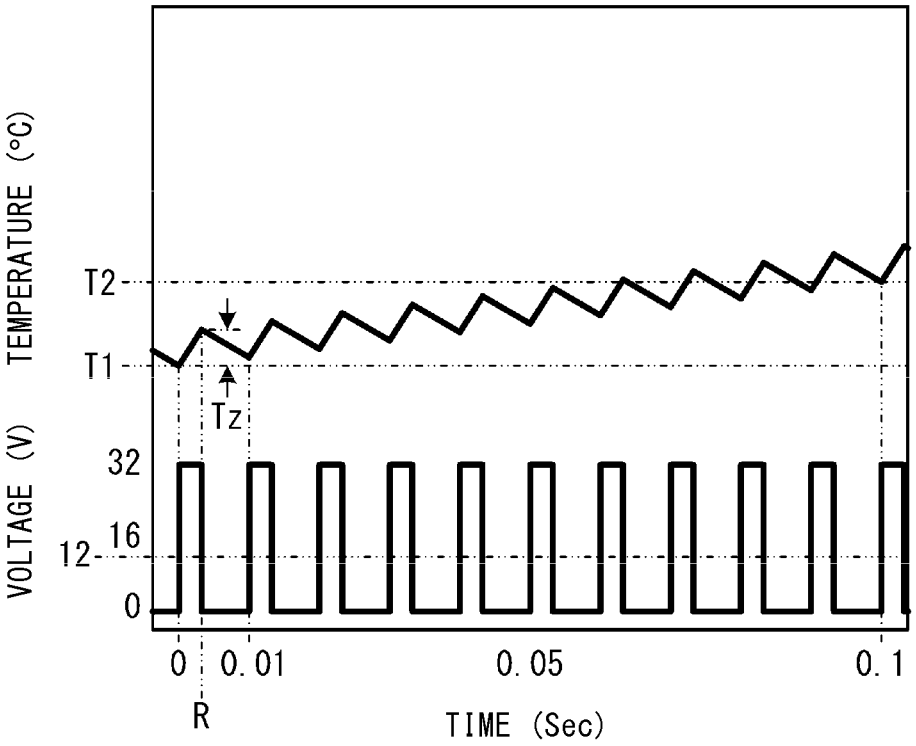
FIG. 5 is a graph showing the change in temperature of the heater element 7 which is energized with the power supply voltage set to 32 V and the PWM frequency set to 100 Hz.

A case will be considered where the sensor control apparatus 1 is connected to the battery 8 whose power supply voltage is 32V, the PWM frequency is set to 100 Hz, and PWM control is performed in which the duty ratio is set such that the temperature of the heater element 7 rises to follow the 12 V temperature rise curve (target). As shown in FIG. 5, the length of one PWM cycle is 0.01 second. Since the temperature of the heater element 7 (heat generation resistor 71) is T1° C. after elapse of the predetermined time from the start of energization, the CPU 11 sets the duty ratio such that the effective value of the voltage applied to the heater element 7 becomes 12 V. During the ON time between 0 and R seconds, 32 V is applied to the heater element 7. The ON time is followed by the OFF time, which lasts from R to 0.01 seconds. After elapse of the OFF time, one cycle ends. During the ON time during which 32 V is applied, the rate of temperature rise of the heater element 7 (heat generation resistor 71) (the slope of a line representing the temperature rise) is the same as that shown in FIG. 4 and is greater than that observed in the case where the power supply voltage is 16 V. The temperature of the heater element 7 rises Tz° C. due to application of 32 V during the ON time, and falls due to natural cooling during the OFF time. Such a cycle in which the temperature rises and falls once is repeated ten times, whereby the temperature of the heater element 7 becomes T2° C. after elapse of 0.1 seconds, following elapse of the predetermined time. The temperature rise Tz° C. of the heater element 7 during the ON time which is observed in the case where the PWM frequency is set to 100 Hz and the power supply voltage is 32 V is smaller than the temperature rise Ty° C. during the ON time which is observed in the case where the PWM frequency is 10 Hz and the power supply voltage is 32 V.

As shown in FIG. 2, in the case where the PWM frequency was set to 100 Hz and the power supply voltage was 32 V (the temperature rise curve obtained in such a case is represented by a solid line), the maximum temperature rise of the heater element 7 per 0.1 second was 18.3° C.

As mentioned above, in the case where the power supply voltage of the battery 8 connected to the sensor control apparatus 1 is 32 V, the temperature rise during the ON time can be rendered relatively small (Tz° C.) by increasing the PWM frequency to 100 Hz. This temperature rise is considerably smaller than the temperature rise Ty° C. observed in the above-described case where the power supply voltage is 32 V and the PWM frequency is set to 10 Hz. As a result, a reduced load is applied to the gas detection element 6, whereby cracking and breakage thereof can be prevented.

Namely, by increasing the PWM frequency to thereby shorten the length of each cycle of PWM control, the ON time in each cycle can be shortened. Therefore, even if a power supply voltage higher than 16 V is applied to the heater element 7, the temperature rise of the heater during the ON time can be held low. Accordingly, by connecting the sensor control apparatus 1 to the battery 8 whose power supply voltage is 32 V, setting the PWM frequency to 100 Hz, and performing PWM control with the duty ratio set such that the temperature rise of the heater per 0.1 second is smaller than 25° C., the load acting on the detection element can be reduced. In addition, even if the ON time is shortened, the effective value of the voltage applied to the heater can be maintained. Therefore, by controlling the effective value of the voltage applied to the heater element 7, namely, by performing PWM control such that the temperature of the heater element 7 follows the 12 V temperature rise curve (target), the electric power supplied to the heater element 7 (heat generation resistor 71) can be secured as in the case of a conventional apparatus. As a result, the gas detection element 6 can be activated quickly.

For the case where the power supply voltage was 32 V, the inventors carried out an experiment of performing PWM control at a PWM frequency of 30 Hz or higher while setting the duty ratio such that the temperature rise of the heater element 7 follows the 12 V temperature rise curve (target). Even in such a case, the gas detection element 6 did not crack nor break. The inventors confirmed that, even in the case where the power supply voltage of the battery 8 is higher than 16 V and therefore PWM control is performed with the 12 V temperature rise curve used as a target, the gas detection element 6 did not crack nor break, so long as the PWM frequency is set to 30 Hz or higher.

The present invention is not limited to the above-described embodiment, and may be modified in various ways without departing from the scope of the invention. In the embodiment, the sensor control apparatus 1 is the ECU of the automobile; however, a control apparatus may be provided independently of the ECU. The gas sensor used in the embodiment is a full range air-fuel ratio sensor 2; however, the present invention may be applied to other types of gas sensors (e.g., an oxygen sensor, an NOx sensor, an air quality sensor, an HC sensor, etc.) which include a gas detection element whose substrate is a solid electrolyte body and a heater element which heats the solid electrolyte body for quick activation.

Also, the present invention aims for a 12 V temperature rise curve, but is not limited to this, and other temperature rise curves, for example, a 10 V temperature rise curve or an 8 V temperature rise curve can be the objective. That is, the effective value of the voltage can be a value of less than 16 V so that a lapse of time from a state of a normal temperature to a temperature at which detecting a gas is possible becomes less than 15 seconds.

The invention has been described in detail with reference to the above embodiments. However, the invention should not be construed as being limited thereto. It should further be apparent to those skilled in the art that various changes in form and detail of the invention as shown and described above may be made. It is intended that such changes be included within the spirit and scope of the claims appended hereto.

This application is based on Japanese Patent Application No. 2013-035376 filed Feb. 26, 2013, incorporated herein by reference in its entirety.

What is claimed is:

1. A heater control method for controlling energization of a heater of a gas sensor the gas sensor comprising:

a gas detection element having at least one cell composed of a solid electrolyte body and a pair of electrodes provided thereon, and a heater which generates heat, when a power supply voltage is applied to the heater from a power supply apparatus, so as to heat and activate the gas detection element, the power supply voltage applied from the power supply apparatus to the heater being higher than 16 V, the heater control method comprising:

controlling energization of the heater by operating the switching means under PWM control at a PWM frequency of 30 Hz or higher, wherein the power supply voltage is applied to the heater when the switching means is turned on, and the power supply voltage is not applied to the heater when the switching means is turned off; and operating the switching means at a duty ratio of less than 100% such that the temperature of the heater does not change 25° C. or more per 0.1 second and such that the PWM control acts to reduce power input to the heater as if supplied at an applied voltage set in advance that is lower than the power supply voltage of higher than 16 V.

2. The heater control method as claimed in claim 1, which comprises operating the switching means at a duty ratio such that an input power to the heater at the applied voltage of higher than 16V is equal to an input power to the heater at the lower applied voltage.

3. The heater control method as claimed in claim 1, which comprises operating the switching means at a duty ratio such that a temperature rise curve of the gas detection element at the applied voltage of higher than 16V follows a temperature rise curve of the gas detection element at the lower applied voltage.

4. A heater control apparatus for controlling energization of a heater of a gas sensor, the gas sensor comprising:

a gas detection element having at least one cell composed of a solid electrolyte body and a pair of electrodes provided thereon, and a heater which generates heat, when a power supply voltage is applied to the header from a power supply apparatus, so as to heat and activate the gas detection element, the power supply voltage applied from the power supply apparatus to the heater being higher than 16 V, the heater control apparatus comprising:

switching means for applying the power supply voltage to the heater when the switching means is turned on and stopping application of the power supply voltage when the switching means is turned off; and control means for controlling energization of the heater by operating the switching means under PWM control at a PWM frequency of 30 Hz or higher, wherein the control means is configured to turn the switching means off and on, said control means performing the PWM control such that the switching means is operated at a duty ratio of less than 100% whereby the temperature of the heater does not change 25° C. or more per 0.1 second, and such that the PWM control acts to reduce power input to the heater as if supplied at an applied voltage set in advance that is lower than the power supply voltage of higher than 16 V.

* * * * *